US007849937B2

(12) United States Patent
Derwand

(10) Patent No.: US 7,849,937 B2
(45) Date of Patent: Dec. 14, 2010

(54) METHOD AND DEVICE FOR PRODUCING A CASED STRING BORE

(76) Inventor: Horst Derwand, Berliner Strasse 9, D-35236 Breidenbach (DE)

( * ) Notice: Subject to any disclaimer, the term of this patent is extended or adjusted under 35 U.S.C. 154(b) by 328 days.

(21) Appl. No.: 12/006,673

(22) Filed: Jan. 4, 2008

(65) Prior Publication Data

US 2008/0164066 A1 Jul. 10, 2008

(30) Foreign Application Priority Data

Jan. 10, 2007 (DE) ..... 10 2007 002 399

(51) Int. Cl.

| | |
|---|---|
| ***E02D 29/00*** | (2006.01) |
| ***E21B 4/18*** | (2006.01) |
| ***E21B 7/20*** | (2006.01) |
| ***E21D 9/10*** | (2006.01) |
| ***E21D 9/12*** | (2006.01) |

(52) U.S. Cl. ..... 175/62; 175/99; 175/171; 405/146; 405/184

(58) Field of Classification Search ..... 175/62, 175/171, 86, 97, 98, 99; 405/184, 138, 146; 15/104.061

See application file for complete search history.

(56) References Cited

U.S. PATENT DOCUMENTS

| | | | | |
|---|---|---|---|---|
| 2,588,068 | A * | 3/1952 | Williams et al. | 175/122 |
| 3,486,571 | A * | 12/1969 | Silverman | 175/5 |
| 4,116,011 | A * | 9/1978 | Girault | 405/134 |
| 5,425,429 | A * | 6/1995 | Thompson | 175/62 |
| 5,439,068 | A | 8/1995 | Huffstutler et al. | |
| 5,707,176 | A * | 1/1998 | Okubo | 405/184 |
| 5,749,678 | A * | 5/1998 | Dose et al. | 405/184 |
| 6,050,351 | A * | 4/2000 | Eckenfels et al. | 175/62 |
| 6,161,631 | A * | 12/2000 | Kennedy et al. | 175/171 |
| 6,955,232 | B2 * | 10/2005 | Flaugere | 175/97 |
| 7,070,359 | B2 * | 7/2006 | Richardson et al. | 405/141 |
| 2004/0245020 | A1 * | 12/2004 | Giroux et al. | 175/61 |
| 2005/0257959 | A1 * | 11/2005 | Richardson et al. | 175/22 |
| 2007/0119626 | A9 * | 5/2007 | Giroux et al. | 175/61 |

FOREIGN PATENT DOCUMENTS

| | | |
|---|---|---|
| DE | 28 29 834 | 1/1979 |
| DE | 100 29 476 | 1/2001 |
| GB | 2 003 211 | 3/1979 |

* cited by examiner

*Primary Examiner*—Jennifer H Gay
(74) *Attorney, Agent, or Firm*—Collard & Roe, P.C.

(57) ABSTRACT

In a method for producing a cased horizontal string bore extending from a well shaft, a starter drill pipe is driven into the rock mass surrounding the well shaft. A hydraulically driven drill motor is arranged in the starter drill pipe and rotates a drilling tool protruding from the leading end of the starter drill pipe. The drill motor is fixed against rotation and axial displacement by a clamping device. When the final depth of the string bore is reached, the drilling tool is retracted into the starter drill pipe by axial movement of the clamping device and a free space is formed at the drift face of the string bore. The free space is filled and sealed by injection of a quick-setting, expanding filling compound. Afterwards, the clamping device, the drill motor and the drilling tool are removed from the drill pipes.

21 Claims, 3 Drawing Sheets

METHOD AND DEVICE FOR PRODUCING A CASED STRING BORE

FIELD OF THE INVENTION

The invention relates to a method for producing a cased string bore extending from a well shaft in the horizontal direction for the installation of a filter string, in which a starter drill pipe and subsequently further drill pipes are driven into the rock mass surrounding the well shaft through an opening in the wall of the well shaft by means of a press arranged in the well shaft.

BACKGROUND OF THE INVENTION

A method of the specified type is used for the sinking of wells which have long been known as "horizontal filter wells". The Fehlmann and Preussag methods are often used to sink these wells. These methods are described in E. Bieske "Bohrbrunnen" ($7^{th}$ ed., 1992, Oldenbourg, Munich, pages 19 to 23.). Both methods involve first the sinking of a perpendicular shaft which reaches down to the aquifer and serves as a starting shaft for driving the horizontal holding strings and, once the holding strings have been completed, is developed into a pump shaft. The shaft construction generally consists in this case of reinforced concrete pipes having an internal diameter of 2.0 m or more, placed one on top of another. The pipes are laid with the aid of hydraulic presses or a superimposed load. The soil infiltrating the pipes is removed. Once the desired depth has been reached, the bottom of the shaft is covered with concrete. Starting from the shaft, horizontal bores are then driven using drill pipes through openings in the shaft wall. Filter pipes are then introduced into these drill pipes before the drill pipes are removed. In the Preussag method, the filter pipes are additionally surrounded by a gravel envelope.

In the known methods, the drill pipes are driven based on the displacement principle by advancing the drill pipes while at the same time removing fine grain. The starter drill pipe is given a conical drill head which penetrates the subsoil during driving of the drill pipes. The drill head has a large number of suitably sized holes. By constantly moving the entire string of pipes, including the drill head, back and forth, the hydrostatic pressure of the groundwater pushes the drilled material into the drill head. A separating plate closes off the drill head from the inside of the drill pipes. Screwed into the separating plate are return rods through which the drilled material and water infiltrating the drill head are conveyed out toward the shaft. In difficult soil conditions, in particular in cohesive or compact formations, the transportation of the drilled material and also the loosening of the soil are assisted by additional flushing with pressurized water. The pressurized water is led through a separate flushing pipe, installed in the string of pipes, to the drill head and issues within the drill head. Once the intended string length has been reached, the return rods and the flushing rods are unscrewed from the partition between the drill head and the first drill pipe and withdrawn toward the shaft, the partition being sealed by a self-closing flap. The drill pipe, which is sealed toward the rock mass, is then available for installation of the filter pipes. Once the filter pipes have been installed and, in the Preussag method, a gravel packing introduced, the drill pipes are gradually withdrawn into the shaft. The drill head is left behind in the rock mass and lost.

The known methods have proven successful in practice. However, they can be used only in soil formations in which the drill head can be advanced and freely flushed. Stones and deposits of clay can constitute insuperable obstacles to drilling in these methods and rock formations cannot be drilled.

Also known from DE 100 29 476 A1 is a drilling device with which, starting from a start pit, a drilling device and subsequently product pipes can be driven in the horizontal direction by means of a hydraulic press unit. The drilling device comprises a shield in which a drive shaft carrying a tool disc is rotatably mounted and can be driven by a motor. Arranged after the tool disc is a cell wall comprising cells which receive drilled material removed by the tool disc. A conveying pipe which is arranged after the cell wall and has a receiving end facing the cell wall can be moved past the cells and conveys the drilled material contained in the cells successively through the product pipes and out of the start pit. The material can be conveyed with the aid of air or water which is led with excess pressure via a further pipe into the cells. This device also has the drawback that the drill head cannot be withdrawn along with the tool disc and cell wall, after completion of a string bore, through the production pipes but must rather be left behind in the string bore as a lost component of the device. Also, if the drilling device becomes damaged or blocked, it is almost impossible to carry out repairs, so it may not be possible to continue the drilling drive operation.

Also known from DE 28 29 834 is a method for drilling a bore hole in a subsoil permeated with boulders or layers of rock using a ground drilling device which consists of a cylindrical drill casing and a rock drill bit and in which the rock drill bit is introduced, with cutting tools drawn into their inner position, into the drill casing in such a way that the movable cutting tools are located below the lower end of the drill casing. Subsequently, the movable cutting tools are moved into their outer cutting position and the rock drill bit is lowered together with and at the same time as the drill casing and they are set in rotation about their common axis to drill a bore hole, the diameter of which is at least equal to the outer diameter of the drill casing. Once the drilling process has been completed, the movable cutting tools are drawn back in, so the rock drill bit can be extracted from the drill casing.

SUMMARY OF THE INVENTION

The object of the invention is to disclose a method for producing a cased string bore extending from a well shaft in the horizontal direction, which method is suitable also for soil formations, such as for example rock, and allows the drilling tools to be adapted to various locally prevailing soil formations. In addition, it should be possible to carry out the method according to the invention effectively and inexpensively while minimizing the risk of accidents.

In a method according to the present invention, a hydraulically driven drill motor having a drilling tool rotationally driven thereby is inserted into a starter drill pipe in such a way that the drilling tool protrudes from the leading end of the starter drill pipe, the drill motor is supported in the starter drill pipe by means of a clamping device engaging the starter drill pipe so as to be fixed against rotation and axial displacement therein, and the starter drill pipe is sealed after the drill motor with the aid of the clamping device, the starter drill pipe and subsequently further drill pipes are driven into the rock mass surrounding the well shaft through an opening in the wall of the well shaft by using a drive means arranged in the well shaft, wherein the drilling tool is rotated by the drill motor, pressurized water is supplied to the drilling tool via a flushing pipe penetrating the clamping device and the drilled material, which is crushed by the drilling tool, is conveyed toward the surface through a conveying channel and a conveying pipe, which extends through the drill pipes to the well shaft, on reaching the final length of the string bore the drilling tool is withdrawn and a free space is formed between the drift face of the string bore and the starter drill pipe, the free space is filled and sealed by injection of an expanding, quick-setting filling compound and once the clamping device has been disengaged, the clamping device, the drill motor and the drilling tool are removed from the drill pipes.

The method according to the invention allows, for example, when starting from a well shaft, the drilling of horizontal string bores for the gathering of groundwater through any desired soil formations, including for example rock, and effective sealing of the end of the string of pipes of the string bore without the drilling tool having to be left behind on the drift face. The method according to the invention therefore allows the use of complex drilling tools. This speeds up the drilling operation and thus helps to reduce costs.

For the purposes of drilling, use is preferably made of a drilling tool having radially movable cutting tools which produce a bore hole, the diameter of which is equal to or greater than the external diameter of the drill pipes. If the soil conditions allow the bore hole to be expanded with the aid of the starter drill pipe, use may also be made of a drilling tool which has radially immovable cutting tools and the invariable external diameter of which is not greater than the internal diameter of the drill pipes.

For injecting the expandable filling compound, the method according to the invention provides that a hollow cylindrical cartridge be filled with the filling compound and the cartridge be hydraulically driven through the conveying pipe up to the clamping device, where it is discharged through the conveying channel penetrating the clamping device and the drill motor into the free space formed before the drilling tool. For the purposes of discharging, the cartridge can contain a scraper which drives the filling compound out of the cartridge and through the conveying channel in a hydraulically driven manner. The scraper and the discharged cartridge can be withdrawn into the shaft with the aid of an entrained cable, thus allowing filling compound to be re-injected if necessary. In the method according to the invention, the filling compound used is preferably a polyurethane injection foam resin. The resin is preferably contained in a destructible container, for example a hose-type cover, which can be introduced into the cartridge. When the cartridge is discharged, the hose-type cover is destroyed and contact of the resin with the water present on the drift face or with air gives rise to a chemical reaction forming a foam body which fills and seals the free space between the starter drill pipe and the drift face.

The free space on the drift face is preferably formed as a result of the fact that the drill motor, with the drilling tool fastened thereto, is retracted into the starter drill pipe. If no suitable devices are provided for this purpose, the free space required can also be formed by retracting the entire string of pipes by the requisite degree.

According to a further proposal of the invention, pressurized water can be used to drive the drill motor and the water returning from the drill motor can be led into the channel for conveying the drilled material. Driving with pressurized water rules out the risk of the drilling region becoming contaminated. The introduction of the water return into the conveying channel assists the conveyance of the drilled material and eliminates the need to use a separate return line.

A further advantageous embodiment of the method according to the invention provides that the water which is supplied to the drilling tool under excess pressure be led through an annular chamber formed between the casing of the drill motor and the starter drill pipe. This prevents the deposition in the inlet in the starter drill pipe of fine-grained drilled material which would obstruct the introduction of the drill motor into the bore hole.

Further, according to the present invention an advantageous device for carrying out the method comprises, a rotationally drivable drilling tool, a hydraulic drill motor for driving the drilling tool, a controllable clamping device by means of which the drill motor can be secured in a drill pipe and which forms a partition sealing the drill pipe, wherein the drill motor and the clamping device have a continuous, central conveying channel which has an inlet in the region of the drilling tool and can be connected at its other end to a conveying pipe.

In an advantageous embodiment, the clamping device can be connected to a traction scraper or traction devil which is movable and securable in the longitudinal direction in the drill pipe. A traction scraper of this type allows the clamping device to be disengaged and moved, together with the drill motor supported on the clamping device, relative to the drill pipe in the longitudinal direction with the aid of the traction scraper even in the event of compressive loading caused by the hydrostatic pressure of groundwater present. This is, for example, expedient in order to withdraw the drilling tool into the drill pipe. Furthermore, in the event of the drilling tool becoming damaged or the drill motor malfunctioning, the entire unit consisting of the drilling tool, drill motor and clamping device can be retracted into the shaft with the aid of the traction scraper. Particularly advantageous is an embodiment in which the clamping device is integrated into the traction scraper, i.e. forms part of the traction scraper. Obviously, the traction scraper also has a rectilinear, central through-channel, thus allowing the conveying channel to be connected to the conveying pipe and the filling compound to be injected as described hereinbefore.

In an advantageous embodiment, the traction scraper has two hydraulically actuatable clamping devices which are coupled together by a double-acting hydraulic cylinder, wherein the two clamping devices and the hydraulic cylinder can be controlled independently of one another by a hydraulic controller. Such an embodiment of the traction scraper is distinguished by a simple and robust design and allows reliable supporting as well as movement of the drill motor within the string of pipes.

According to a further proposal of the invention, an advantageous embodiment of the clamping device has a substantially cylindrical clamping sleeve which is made of elastomeric material and arranged on a cylindrical support body between two flanges which are movable relative to each other, wherein the external diameter of the clamping sleeve can be radially enlarged by drawing the flanges closer together. This embodiment of the clamping sleeve allows high retention forces and ensures effective sealing on the inner wall of the drill pipes.

According to a further proposal of the invention, the drill motor can be driven with pressurized water and its return for the pressurized water can open into the conveying channel. This assists the conveyance of the drilled material.

Preferably, the conveying channel opens out in the center of the drilling tool and penetrates the drill motor and the clamping device. Furthermore, the conveying channel can have at its inlet a ring gauge, the diameter of which is approx. 10% smaller than the diameter of the conveying channel. This ensures that the conveying channel is infiltrated only by pieces of rock which are much smaller than the internal diameter of the conveying channel, thus preventing the pieces of rock from becoming stuck in the conveying channel. The cutting tools of the drilling tool are in this case arranged in such a way that only pieces of rock, the diameter of which is smaller than the opening in the ring gauge, can pass to the inlet.

According to a further proposal of the invention, the drilling tool has radially movable cutting tools which can be moved by the cutting forces into a radially outer position, the drilled bore hole having a diameter which is equal to or greater than the external diameter of the drill pipes and the cutting tools being movable into a radially inner position in which they can be drawn, together with the drill motor, through the drill pipes.

For injecting the expandable filling compound, the device has, according to a further proposal of the invention, a hollow cylindrical cartridge which can be moved with the aid of pressurized water through the conveying pipe up to the connection point of the conveying channel and the internal diameter of which corresponds to the internal diameter of the conveying channel, the cartridge containing a scraper which can be acted on with pressurized water through an opening in the base of the cartridge and which is fastened to a cable of a cable winch arranged in the shaft. This cartridge allows the filling compound to be reliably injected into the free space before the drilling tool and a plurality of injections can be carried out in succession if necessary.

BRIEF DESCRIPTION OF THE DRAWINGS

The invention will be described hereinafter in greater detail with reference to exemplary embodiments illustrated in the drawings, in which.

DETAILED DESCRIPTION OF THE PREFERRED EMBODIMENTS

Figure 1:
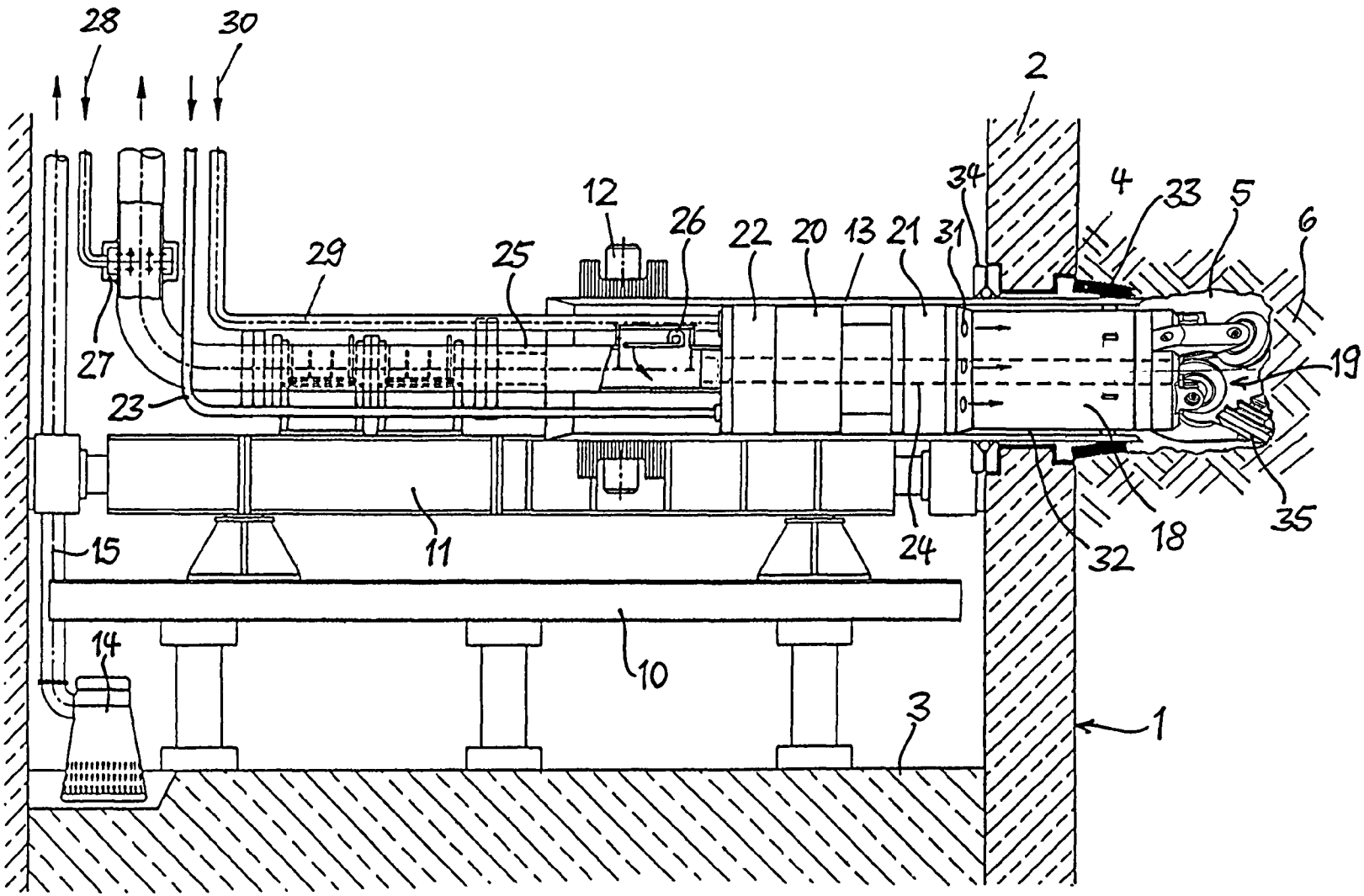
FIG. 1 is a cross section through the lower end of a well shaft with the drilling apparatus arranged therein in the initial phase of the production of a horizontal string bore.

FIG. 1 shows the bottom region of a vertical well shaft 1 comprising a shaft wall 2 formed from concrete pipes and a shaft bottom 3 covered with concrete. Provided in the shaft wall 2 is an opening 4 through which a horizontal string bore can be drilled into the soil surrounding the well shaft 1 in order subsequently to develop the string bore into a holding string of the well.

The well shaft 1 contains the equipment required to produce a string bore. A hydraulic drive means 11 is arranged on a working platform 10 and braced to the shaft wall 2 on opposite sides. The hydraulic drive means 11 comprises substantially two double-acting lifting cylinders (not shown) which are arranged parallel to each other and of which the drive force, acting in the horizontal direction, is transmitted to the respectively clamped drill pipe, in this case the starter drill pipe 13, by means of a hydraulically actuatable clamp 12. A submersible pump 14 arranged on the bottom 3 of the shaft below the working platform 10 conveys groundwater which enters the shaft during the drilling operation and during the subsequent development of the bore into a cesspit above ground via a riser pipe 15.

Inserted into the starter drill pipe 13 is a drill motor 18 which drives in rotation a drilling tool 19 protruding from the starter drill pipe 13. The trailing end of the drill motor 18 is flanged onto a traction scraper 20. The traction scraper has two annular clamping devices 21, 22 which are set apart from each other and secure the traction scraper in the starter drill pipe 13. The clamping devices 21, 22 also support the drill motor 18 in the axial direction and prevent it from rotating in the starter drill pipe 13. The traction scraper 20 can alter its axial position within the drill pipe in that firstly one of the clamping devices 21, 22 is loosened, its distance from the other clamping device is altered and the clamping device is then retightened and in that subsequently the same operation is performed with the other of the clamping devices 21, 22. In this way, the traction scraper is able to advance in the drill pipe and transport the drill motor connected thereto through the drill pipe.

The drill motor 18 and the traction scraper 20 are driven hydraulically with water which is supplied at elevated pressure by a pump arranged above ground via a pipe 23. The returning water is led into a conveying channel 24 which centrally penetrates the drill motor 18 and the traction scraper 20 in the longitudinal direction and is connected to a conveying pipe 25 on the back of the traction scraper 20. At the front of the drill motor 18, the conveying channel 24 has an inlet for the drilled material removed by the drilling tool 19. Arranged in the conveying pipe 25, after the traction scraper 20, is a remote-control flap 26 which can be used to seal the conveying pipe 25. The conveying pipe 25 also leads above ground to a cesspit. A particular type of pump can be provided for conveying the drilled material upward. FIG. 1 shows a mammoth pump 27 which is fed with compressed air 28.

The traction scraper 20 is also connected to a flushing pipe 29 through which pressurized water 30 is supplied continuously throughout the drilling process. The water 30 passes through channels in the traction scraper 20, on the front thereof, and issues through openings 31 into an annular chamber 32 formed between the outer surface of the drill motor 18 and the inner wall of the starter drill pipe 13. The water passes through the starter drill pipe 13 to the drilling tool 19 in order to cool the drilling tool and to convey the drillings removed during the drilling process into the conveying channel 24 and through the conveying channel and the conveying pipe 25.

FIG. 1 shows the drilling of the string bore 5 in the initial stage, once the drilling tool 19 has penetrated a rupture disc 33 closing the opening 4 and entered the soil adjacent to the shaft wall 2. The starter drill pipe 13 is guided in the opening 4 and sealed using a sealing means 34. The starter drill pipe 13 is non-rotatably held in the clamp 12 and is pressed by the drive means 11 in the direction of the string bore 5. The driving force of the drive means 11 is transmitted from the starter drill pipe 13 via the clamping devices 21, 22 to the traction scraper 20 and therefrom to the drill motor 18 and thus to the drilling tools 19 which, driven in rotation by the drill motor 18, enter the soil 6 under the action of the driving force.

The drilling tool 19, shown by way of example in FIG. 1 as a roller drill bit, is provided with radially movable cutting tools 35 which, under the action of the drilling forces, are brought into their radially swiveled-out position in which the bore hole diameter produced is somewhat larger than the external diameter of the starter drill pipe 13. The starter drill pipe 13 is therefore able to penetrate the drilled bore hole without encountering much resistance.

Once the drilling process has progressed to the stage at which the usable drive length of the starter drill pipe 13 has been used up, the drilling process is interrupted in order to join a new drill pipe to the starter drill pipe 13. For this purpose, the flap 26 is closed and the conveying pipe 25 cut off after the flap 26. The supply of pressurized water via the pipe 23 and the supply of flushing water via the flushing pipe 29 are interrupted and the pipe 23 and the flushing pipe 29 are also cut off. The clamp 12 is opened and returned using the drive means 11 to the starting position in order to receive a new drill pipe to be joined. Once the new drill pipe has been inserted, the clamp 12 is closed, the previously cut-off pipe connections are re-established and the flap 26 is opened again, thus allowing the drilling process with a string of pipes extended by one drill pipe to be continued as described. This process is repeated until the string bore 5 has reached the intended length and the drilling process can be terminated.

Figure 2:
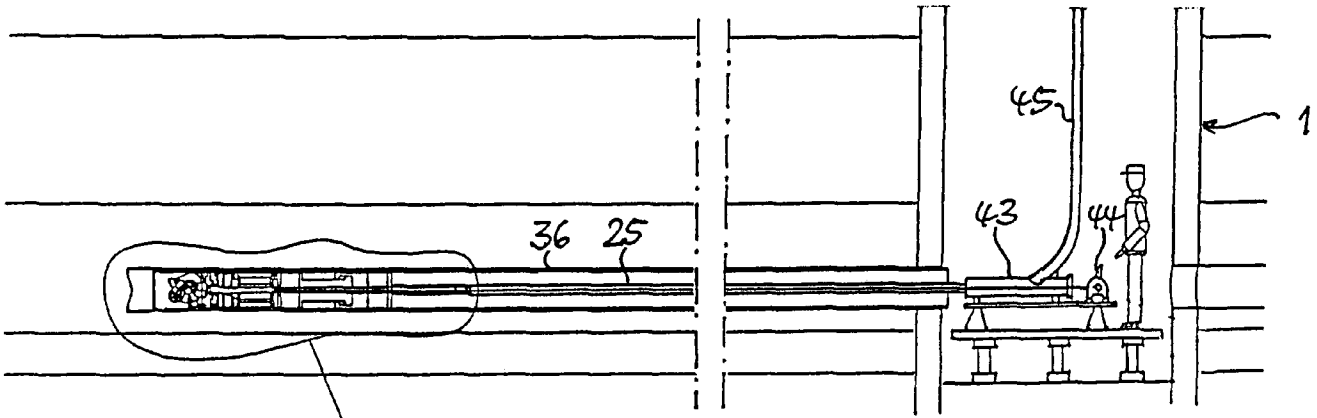
FIG. 2 is a cross section through the lower end of a well shaft with a driven string bore and a means for injecting a filling compound.
Figure 3:
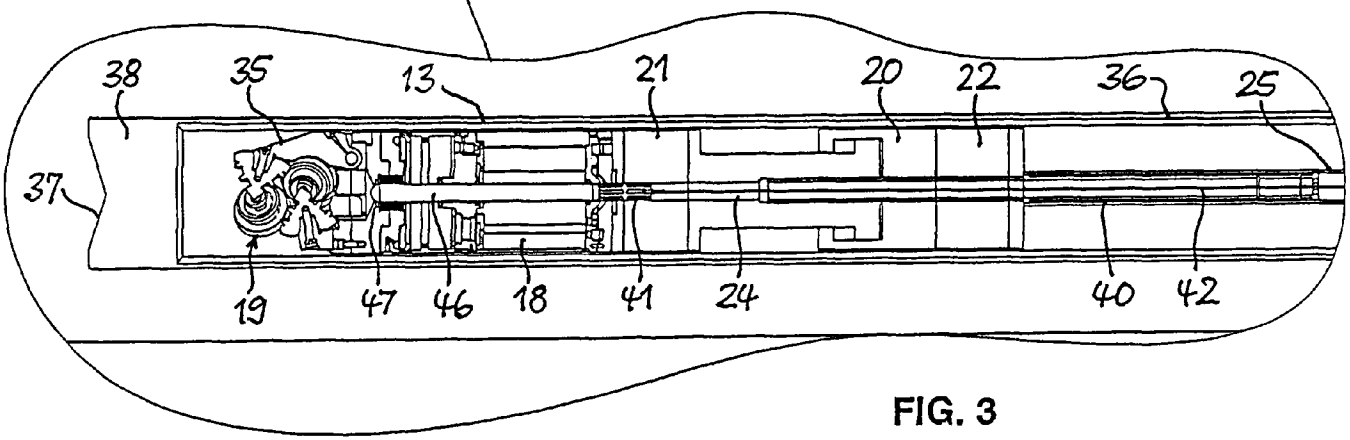
FIG. 3 shows an enlarged detail of the injection region.

In order to allow the drilling apparatus, which is now no longer required, to be dismantled and the filter pipes to be installed, it is now necessary to seal the string of pipes lining the drilled string on the drift face of the string bore 5. The measures and means provided for this purpose will be described hereinafter in greater detail with reference to FIGS. 2 and 3.

In a first step, the drill motor 18 and the drilling tool 19 are retracted with the aid of the traction scraper 20 a certain distance into the starter drill pipe 13 of the string of pipes 36, so the drilling tool 19 is located within the starter drill pipe 13. In this process, the radially movable cutting tools 35 are folded inward as a result of contact with the end face of the starter drill pipe 13, so they do not impede the withdrawal of the drilling tool 19. The movement of the traction scraper 20 is controlled in such a way that one of the clamping devices 21, 22 is clamped at all times. This ensures that the inlet end of the string of pipes 36 (FIG. 3) remains sealed by the traction scraper 20 and the groundwater present cannot infiltrate the string of pipes 36.

Figure 4:
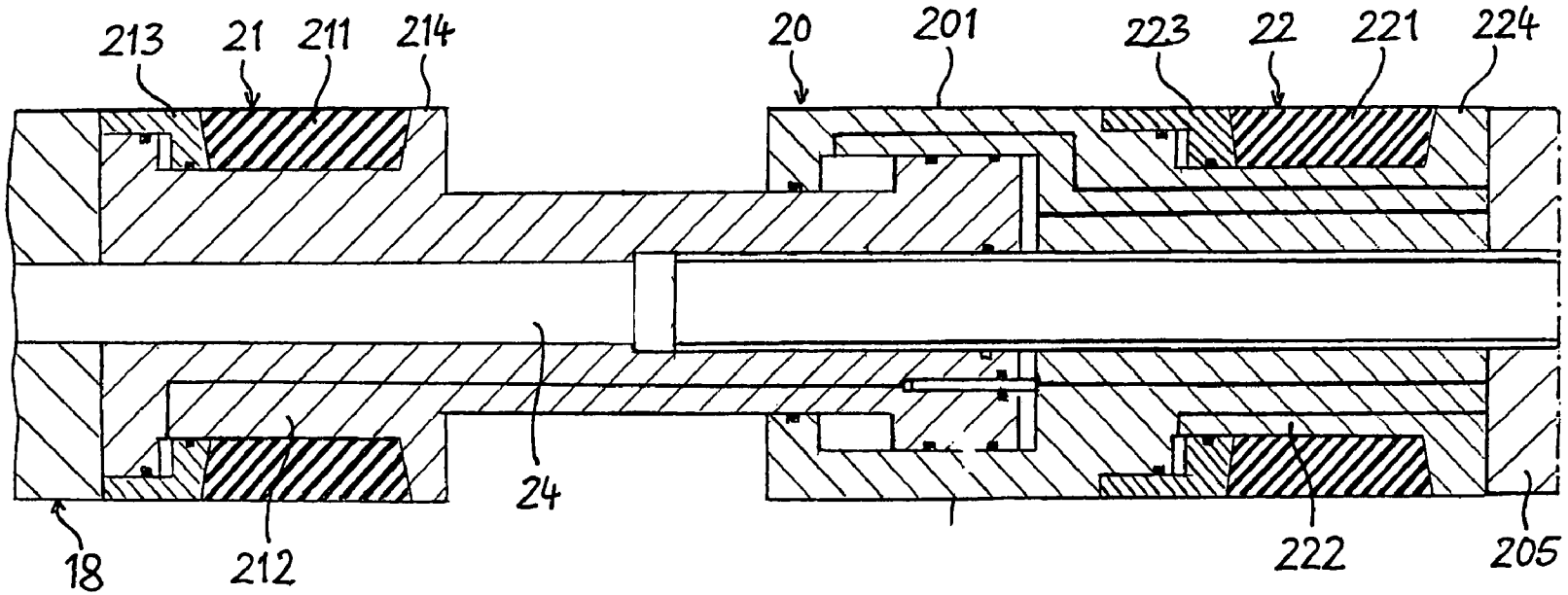
FIG. 4 shows an enlarged detail of the traction scraper shown in FIG. 3.

As shown in FIG. 4, each one of clamping devices 21, 22 of the traction scraper 20 has a substantially cylindrical clamping sleeve 211, 221 which is made of elastomeric material and is arranged on a cylindrical support body 212, 222 between two flanges 213, 214; 223, 224. One flange 213, 223 of each of the clamping devices 21, 22 forms a hydraulically actuatable piston which is movable towards the opposite flange 214, 224 upon application of hydraulic pressure. Applying pressure to the piston shaped flanges 213, 223 will draw the opposite flanges 213, 214; respectively 223, 224 facing a clamping sleeve 211; respectively 221 closer together and will radially enlarge the external diameter of the clamping sleeves and bring the clamping sleeves in retaining and sealing engagement with a surrounding drill pipe. The clamping devices 21, 22 are coupled together by a double-acting hydraulic cylinder 201. Via conduits in the traction scraper 20 a hydraulic controller 205 controls the two clamping devices 21, 22 and the hydraulic cylinder 201 independently of one another depending on operating commands of a drilling operator.

The withdrawal of the drilling tool 19 creates in the region of the drift face 37 a free space 38 so that the free space can be filled and sealed with an expandable filling compound. In preparation for the injection of the filling compound, the flap 26 is first closed and the conveying pipe 25 in the well shaft then cut off from the upward riser pipe.

Provided for injecting the filling compound is a hollow cylindrical cartridge 40, the external diameter of which is adapted to the internal diameter of the conveying pipe 25 and configured so as to be able to be slid hydraulically through the conveying pipe 25 up to the connection end connected to the traction scraper 20. The hole in the cartridge 40 has an internal diameter corresponding to the internal diameter of the conveying channel 24, which is smaller than the internal diameter of the conveying pipe 25, the conveying channel penetrating the traction scraper 20 and the drill motor 18. The hole in the cartridge contains a cylindrical scraper which rests against a stop at the base of the cartridge 40 and can be acted on hydraulically through an opening in the base of the cartridge 40. The scraper 41 is also connected to a cable 42 leading through the opening in the base of the cartridge 40 and from there through a sluice chamber 43 to a cable winch 44. The filling compound to be injected is contained in an elongate, cylindrical container 46 made preferably of plastics material. The container 46 is introduced into the hole in the cartridge so as to precede the scraper 41. Subsequently, the cartridge thus filled is inserted base first into the front of the sluice chamber 43 and the leading end of the sluice chamber 43 thus filled is flanged onto the conveying pipe 25 leading to the traction scraper 20. The accordingly sealed sluice chamber 43 is connected to a pressure pipe 45 through which pressurized water can be supplied for driving the cartridge 40. The cable 42, which is fastened to the scraper 41 in the cartridge 40, is guided out of the sluice chamber 43 to the cable winch 44 by a sealed guide.

In order to inject the filling compound, the flap 26 is opened and pressurized water led into the sluice chamber 43 via the pressure pipe 45. As a result, the cartridge 40 is moved up to the end of the conveying pipe 25 that is connected to the traction scraper 20 where it is secured to the relatively narrow opening in the conveying channel 24. In this process, the cable 42 is entrained and unwinds from the cable winch 44. From this stage, the water pressure is able to drive forward only the scraper 41, so the scraper leaves the cartridge 40 and, propelling in front of it the container 46 containing the filling compound, is moved along the conveying channel 24 until it is halted by a relatively narrow ring gauge 47 at the inlet of the conveying channel 24. The container 46 is destroyed by the contact with the ring gauge 47 and pressed, together with the filling compound contained therein, through the ring gauge 47 and the drilling tool 19 into the free space 38 on the drift face 37. A chemical reaction in conjunction with the water present causes the filling compound to expand, so the filling compound fills the free space 38 and the inlet of the string of pipes 36 up to the drilling tool 19 and then sets. Suitable filling compounds include polyurethane injection foam resins which have a large expansion volume and set very quickly.

After a period of time required for the setting of the filling compound, the sluice chamber 43 is depressurized and a test is carried out to check whether the injection has been successful. The injection has been successful if the scraper 41 remains in the injection position and there is no discernible ingress of water from the head side through the conveying pipe 25. The scraper 41 and the cartridge 40 are then withdrawn into the sluice chamber 43 with the aid of the cable winch 44. If the injection has not yet produced an adequate seal, it can be repeated as described.

Once the string of pipes 36 has been successfully sealed on the drift face by the expanded filling compound, the drill motor can be dismantled, along with the drilling tool and the traction scraper, from the string of pipes. For this purpose, the traction scraper 20 is hydraulically activated in such a way that it moves in stages through the string of pipes 36 to the well shaft, towing the drill motor 18 with the drilling tool 19 after it. Once it has arrived at the shaft-side end of the string of pipes 36, the traction scraper 20 is removed, along with the drill motor 18 and drilling tool 19, from the string of pipes 36 and stored outside the well shaft until it is reused. Subsequently, the string bore can be developed in the conventional manner with the filter pipes and gravel packing.

What is claimed is:

1. A method for producing a cased string bore extending from a well shaft in the horizontal direction into a rock wall mass surrounding the well shaft, for the installation of a filter string, comprising the steps of:

inserting a hydraulically driven drill motor having a drilling tool rotationally driven thereby into a starter drill pipe in such a way that the drilling tool protrudes from the leading end of the starter drill pipe;

supporting the drill motor in the starter drill pipe by means of an engaging clamping device engaging the starter drill pipe so as to be fixed against rotation and axial displacement, and sealing the starter drill pipe after the drill motor with the aid of the clamping device;

driving the starter drill pipe and subsequently further drill pipes into the rock mass surrounding the well shaft through an opening in the wall of the well shaft by using a drive means arranged in the well shaft while rotating the drilling tool by the drill motor;

supplying pressurized water to the drilling tool via a flushing pipe penetrating the clamping device and conveying the drilled material, which is crushed by the drilling tool, toward the surface through a straight conveying channel penetrating the drill motor and the clamping device in a longitudinal direction and through a conveying pipe, which is connected to the conveying channel and extends through the drill pipes to the well shaft;

on reaching the final length of the string bore retracting the drilling tool or the string of drill pipes and forming a free space between the drift face of the string bore, the drilling tool and the starter drill pipe;

filling and sealing the free space by injection of an expanding filling compound through the conveying pipe and the conveying channel into the free space; and once the string of pipes has been successfully sealed on a drift face by setting of the expanded filling compound disengaging the clamping device and removing the clamping device, the drill motor and the drilling tool from the drill pipes.

2. The method of claim 1 further comprising using a drilling tool having radially movable cutting tools which produce a bore hole, the diameter of which is equal to or greater than the external diameter of the drill pipes.

3. The method of claim 1 further comprising filling a hollow cylindrical cartridge with the filling compound and driving the cartridge through the conveying pipe up to the clamping device, where the cartridge is discharged through the conveying channel penetrating the clamping device and the drill motor into the free space formed before the drilling tool.

4. The method of claim 3, further comprising pressing the filling compound out of the cartridge and through the conveying channel by a hydraulically driven scraper arranged in the cartridge.

5. The method of claim 4 further comprising drawing the scraper and the discharged cartridge into the shaft with the aid of an entrained cable.

6. The method of claim 1 further comprising using a polyurethane injection foam resin as the filling compound.

7. The method of claim 1 further comprising enclosing the filling compound in a destructible hose-type cover adapted to be inserted into the cartridge and destroyed when the cartridge is discharged.

8. The method of claim 1 wherein the drilling tool is drawn into the starter drill pipe to form the free space.

9. The method of claim 1 further comprising using water to drive the drill motor and leading the water returning from the drill motor into the channel for conveying the drilled material.

10. The method of claim 1 further comprising leading the water which is supplied to the drilling tool under excess pressure through an annular chamber formed between the casing of the drill motor and the starter drill pipe.

11. A device for producing a cased string bore extending from a well shaft in the horizontal direction for subsequent installation of a filter string comprising a rotationally drivable drilling tool, a hydraulic drill motor for driving the drilling tool, a controllable clamping device by means of which the drill motor is secured in the drill pipe and which forms a partition sealing the drill pipe against infiltration of groundwater, wherein the drill motor and the clamping device have a continuous, central conveying channel which has an inlet in a region of the drilling tool and is adapted to be connected at an other end to a conveying pipe, the conveying channel conveying a filling compound, and a hydraulically driven scraper adapted to press the filling compound though the conveying channel out of the inlet.

12. The device of claim 11 wherein the clamping device is connected to a traction scraper which is movable and securable in a longitudinal direction in the drill pipe.

13. The device of claim 12 wherein the clamping device is integrated into the traction scraper.

14. The device of claim 12 wherein the traction scraper has a rectilinear, central through-channel forming a conveying channel which is adapted to be connected to the conveying pipe.

15. The device of claim 12 wherein the traction scraper has two hydraulically actuatable clamping devices which are coupled together by a double-acting hydraulic cylinder, wherein the two clamping devices and the hydraulic cylinder are controlled independently of one another by a hydraulic controller.

16. The device of claim 11 wherein the clamping device has a substantially cylindrical clamping sleeve which is made of elastomeric material and arranged on a cylindrical support body between two flanges which are movable relative to each other, wherein the external diameter of the clamping sleeve is adapted to be radially enlarged by drawing the flanges closer together.

17. The device of claim 11 wherein the drill motor is driven with water and a return of the drill motor opens into the conveying channel.

18. The device of claim 11 wherein the conveying channel is straight, opens out in the center of the drilling tool and penetrates the drill motor and the clamping device.

19. The device of claim 11 wherein a ring gauge is disposed at the inlet of the conveying channel, a diameter of which ring gauge is approximately 10% smaller than a diameter of the conveying channel.

20. The device of claim 11 wherein the drilling tool has radially movable cutting tools which are moved by the cutting forces into a radially outer position, the drilled bore hole having a diameter which is equal to or greater than an external diameter of the drill pipe receiving the drill motor and the cutting tools being movable into a radially inner position in which they can be drawn, together with the drill motor, through the drill pipes.

21. The device of claim 11 further comprising a hollow cylindrical cartridge which is movable with the aid of pressurized water through the conveying pipe up to the connection point of the conveying channel, an internal diameter of which cartridge corresponds to an internal diameter of the conveying channel, wherein the cartridge contains the hydraulically-driven scraper which is acted on with pressurized water through an opening in a base of the cartridge, and which is fastened to a cable of a cable winch.

* * * * *